US008890800B2

(12) United States Patent
Miyasaka et al.

(10) Patent No.: US 8,890,800 B2
(45) Date of Patent: Nov. 18, 2014

(54) DRIVING METHOD OF ELECTROPHORETIC DISPLAY DEVICE, ELECTROPHORETIC DISPLAY DEVICE AND ELECTRONIC APPARATUS

(75) Inventors: Eiji Miyasaka, Nagano-ken (JP); Kazuki Imai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 13/306,267

(22) Filed: Nov. 29, 2011

(65) Prior Publication Data

US 2012/0139967 A1 Jun. 7, 2012

(30) Foreign Application Priority Data

Dec. 1, 2010 (JP) ..... 2010-268774

(51) Int. Cl.
*G09G 3/34* (2006.01)

(52) U.S. Cl.
CPC ..... *G09G 3/344* (2013.01); *G09G 2320/0247* (2013.01); *G09G 2300/0857* (2013.01); *G09G 2320/0209* (2013.01); *G09G 2320/0252* (2013.01)
USPC ..... 345/107

(58) Field of Classification Search
CPC .... G02F 1/167; G09G 3/344; G09G 2300/08; G09F 9/372; G02B 26/026
USPC ..... 345/107
See application file for complete search history.

(56) References Cited

U.S. PATENT DOCUMENTS

| | | | | |
|---|---|---|---|---|
| 7,319,554 | B1 * | 1/2008 | Abe et al. | 359/296 |
| 2007/0247417 | A1 * | 10/2007 | Miyazaki et al. | 345/107 |
| 2009/0058798 | A1 * | 3/2009 | Miyazaki | 345/107 |
| 2009/0073111 | A1 | 3/2009 | Miyazaki | |
| 2009/0115763 | A1 | 5/2009 | Inoue | |
| 2009/0167754 | A1 | 7/2009 | Hatta | |
| 2009/0195566 | A1 | 8/2009 | Miyazaki | |
| 2010/0118046 | A1 * | 5/2010 | Miyasaka et al. | 345/589 |
| 2010/0134407 | A1 * | 6/2010 | Wang et al. | 345/107 |

FOREIGN PATENT DOCUMENTS

| | | | |
|---|---|---|---|
| JP | 2008-083413 | A | 4/2008 |
| JP | 2009-134245 | A | 6/2009 |
| JP | 2010-211048 | A | 9/2010 |
| JP | 2010-211049 | A | 9/2010 |

* cited by examiner

*Primary Examiner* — Chanh Nguyen
*Assistant Examiner* — Sanghyuk Park

(57) ABSTRACT

In an image rewriting process of rewriting an image displayed on a display section by applying any one of a first electric potential, a second electric potential and voltage based on a driving pulse signal to each of a plurality of pixel electrodes and by moving electrophoretic particles by an electric field generated between the pixel electrodes and a common electrode, a first pulse application process which uses the driving pulse signal with the pulse width of the first electric potential being a first width, a second pulse application process which uses the driving pulse signal with the pulse width of the first electric potential being a second width longer than the first width, and a third pulse application process which uses the driving pulse signal with the pulse width of the first electric potential being a third width shorter than the second width, are sequentially performed.

9 Claims, 11 Drawing Sheets

FINAL SECOND PULSE APPLICATION

DRIVING STOP AFTER SECOND PULSE APPLICATION

FINAL THIRD PULSE APPLICATION

COMPARATIVE EXAMPLE (WHITE WRITING)

COMPARATIVE EXAMPLE (BLACK WRITING)

PRESENT EMBODIMENT (WHITE WRITING)

PRESENT EMBODIMENT (BLACK WRITING)

DRIVING METHOD OF ELECTROPHORETIC DISPLAY DEVICE, ELECTROPHORETIC DISPLAY DEVICE AND ELECTRONIC APPARATUS

CROSS-REFERENCE TO RELATED APPLICATION

This application claims priority to Japanese Patent Application No. 2010-268774 filed on Dec. 1, 2010. The entire disclosure of Japanese Patent Application No. 2010-268774 is hereby incorporated herein by reference.

BACKGROUND

1. Technical Field

The present invention relates to a driving method of an electrophoretic display device, an electrophoretic display device, and an electronic apparatus.

2. Related Art

In recent years, a display panel having a memorizing ability, which is capable of retaining an image even though power is cut off, has been developed and used for an electronic watch or the like. As the display panel having the memorizing ability, an EPD (electrophoretic display) device, a liquid crystal display device having a memorizing ability, or the like has been proposed.

In the electrophoretic display device, it is known that flickering occurs if driving is performed using a signal having a long pulse width at an initial driving time when color is rapidly changed. A driving method of an electrophoretic display device disclosed in JP-A-2009-134245 includes a first pulse application process of applying a first pulse signal to a common electrode and a second pulse application process of applying a second pulse signal having a pulse width longer than that of the first pulse signal to the common electrode. The first pulse application process is performed at an initial driving time when color is rapidly changed, and the second pulse application process is performed after the displayed color is appropriately close to a desired color, to thereby prevent flickering.

In this regard, in the electrophoretic display device, such a display performance that an image can be clearly displayed by a fine line having a width of one or two pixels has been demanded. In the driving method of the electrophoretic display device disclosed in JP-A-2009-134245, it has been experimentally confirmed that such a phenomenon occurs that a color displayed by a final pulse is spread to a display area of adjacent pixels which display a different color. In a case where the number of displayed pixels is large, or in a case where expression of a fine line level is not necessary, there is no problem in the driving method of the electrophoretic display device disclosed in JP-A-2009-134245. However, in a case where the number of displayed pixels is limited and fine expression ability is demanded as in a display section of a wrist watch or a portable device, further improvement is necessary.

SUMMARY

An advantage of some aspects of the invention is that it provides a driving method of an electrophoretic display device and the like which are capable of clearly displaying fine lines, patterns and shapes while performing a high contrast display by suppressing occurrence of flickering.

(1) An aspect of the invention is directed to a driving method of an electrophoretic display device including a display section in which an electrophoretic element including electrophoretic particles is disposed between a pair of substrates and a plurality of pixels capable of displaying at least a first color and a second color is arranged, wherein a pixel electrode corresponding to each pixel is formed between one of the substrates and the electrophoretic element and a common electrode which faces the plurality of pixel electrodes is formed between the other one of the substrates and the electrophoretic element, the method including: rewriting an image displayed on the display section by applying a voltage based on a driving pulse signal, in which a first electric potential and a second electric potential are repeated, to the common electrode, by applying any one of the first electric potential, the second electric potential and the voltage based on the driving pulse signal to each of the plurality of pixel electrodes, and by moving the electrophoretic particles by an electric field generated between the pixel electrodes and the common electrode. Here, the rewriting includes: a first pulse application using the driving pulse signal with the pulse width of the first electric potential being a first width; a second pulse application using the driving pulse signal with the pulse width of the first electric potential being a second width longer than the first width, after the first pulse application; and a third pulse application using the driving pulse signal with the pulse width of the first electric potential being a third width shorter than the second width, after the second pulse application.

According to this aspect of the invention, since the first pulse application, the second pulse application and the third pulse application are sequentially performed as the rewriting, it is possible to clearly display fine lines, patterns and shapes while performing a high contrast display by suppressing occurrence of flickering.

In this aspect of the invention, the driving pulse signal supplied to the common electrode is changed in the first, second and third pulse applications. Specifically, the driving pulse signal with the pulse width of the first electric potential being a first width (hereinafter, referred to as a first pulse signal), the driving pulse signal with the pulse width of the first electric potential being a second width longer than the first width (hereinafter, referred to as a second pulse signal), and the driving pulse signal with the pulse width of the first electric potential being a third width shorter than the second width (hereinafter, referred to as a third pulse signal), are used.

Firstly, in a section where flickering occurs if a voltage based on the second pulse signal is applied, the first pulse application is performed. In the first pulse application, since the voltage based on the first pulse signal in which the pulse width of the first electric potential is short compared with the second pulse signal is applied, a rapid color change is suppressed to prevent flickering. Then, in a section where flickering does not occur even if a voltage based on the second pulse signal is applied, the second pulse application is performed, and thus, the voltage based on the second pulse signal is applied to the common electrode. The pulse width of the second pulse signal is sufficiently long such that the electrophoretic particles can be sufficiently moved to obtain a desired reflectance. Thus, it is possible to enhance the contrast. On the other hand, there is a possibility that the electrophoretic particles move to a display area of adjacent pixels along an electric field in an inclined direction due to the long pulse width to blur a displayed image. Thus, the third pulse application is performed to return the electrophoretic particles which are spread to the display area of the adjacent pixels to the vicinity of a central boundary line with respect to the adjacent pixels.

It is possible to suppress occurrence of flickering through the first pulse application and the second pulse application, to thereby achieve a high contrast display. Further, it is possible to clearly display fine lines, patterns and shapes through the third pulse application.

In this respect, the central boundary line is a line obtained by connecting the centers of gaps between the pixel electrodes in each of a row direction and a column direction. In other words, the central boundary line is a line which indicates the boundary of the pixels in each of the row and column directions when each pixel is given the same area (for example, see a central boundary line 8 in FIG. 4C). Further, the first electric potential and the second electric potential refer to different electric potentials which represent a high level and a low level of the driving pulse signal. The first color and the second color are at least two colors which can be displayed by the electrophoretic display device. For example, in an electrophoretic method of a two-particle system microcapsule type, a dispersion liquid is colorless and transparent, and electrophoretic particles are black or white. An electrophoretic display section of such a method uses two colors of black and white as base colors and can display at least two colors. At this time, black which is one color of the electrophoretic particles may be assigned as the first color, and white may be assigned as the second color. Contrarily, white may be assigned as the first color, and black may be assigned as the second color.

Any one of the first electric potential, the second electric potential and the voltage based on the driving pulse signal is applied to each of the plurality of pixel electrodes according to an image to be displayed. For example, in a case where full driving for drawing in the entire display section is performed, the first electric potential or the second electric potential is applied to each of the plurality of pixel electrodes according to an image to be displayed. Further, in a case where partial driving for driving some pixels of the display section is performed, for example, a signal obtained by reversing the driving pulse signal is supplied to the pixel electrodes of the pixels in which the displayed color is changed, and a signal equivalent to the driving pulse signal is supplied to the pixel electrodes of the pixels in which the displayed color is not changed.

(2) In this driving method of the electrophoretic display device, the electrophoretic particles may include a first electrophoretic particle which displays the first color and a second electrophoretic particle which displays the second color. Further, the third pulse application may use the driving pulse signal which displays the first color to terminate driving of the common electrode in a case where the diameter of the second electrophoretic particle is larger than the diameter of the first electrophoretic particle, and may use the driving pulse signal which displays the second color to terminate driving of the common electrode in a case where the diameter of the second electrophoretic particle is equal to or smaller than the diameter of the first electrophoretic particle.

In the rewriting, it has been experimentally confirmed that the electrophoretic particles of the color displayed by the final pulse are easily spread to the display area of the adjacent pixels. Here, the final pulse refers to a pulse immediately before the driving of the common electrode and the pixel electrodes is stopped (high impedance state). At this time, in a case where the pulse width of the final pulse is short, the spreading becomes small, but there is no change in the tendency that the electrophoretic particles of the color displayed by the final pulse are easily spread.

In this regard, if the electrophoretic display device includes the first electrophoretic particles for displaying the first color and the second electrophoretic particles for displaying the second color, the color of the particles of a large diameter are easily noticeable in the display section (see FIG. 7E). This is because the particles of a small diameter may be inserted into gaps between the particles of the large diameter and may be present in a dispersed state. Further, this is because even one large diameter particle may occupy a large display area corresponding to the plurality of small diameter particles which are gathered together.

Thus, in a case where the color of the large diameter particles is spread by the final pulse, even though the color of the large diameter particles is present in the vicinity of the central boundary line without intrusion into the display area of the adjacent pixels, the color of the large diameter particles is easily noticeable. Thus, it seems that the color of the large diameter particles is spread to the area of the adjacent pixels.

With the above-described configuration, the above problem is solved by driving the final pulse in the third pulse application so that the color of the electrophoretic particles with the small diameter is displayed, to thereby improve visual quality to clearly display fine lines, patterns and shapes.

In this respect, it is assumed that black which is one color of the electrophoretic particles is assigned as the first color, and white is assigned as the second color. Then, a specific example in a case where the diameter of the electrophoretic particles of the white color (second color) is large will be described. If the large particles of the white color (second color) are negatively charged and the small particles of the black color (first color) are positively charged, the final pulse may be driven so that the small black particles are pulled toward the common electrode side which is viewed. If full driving for drawing in the entire display section is performed, an electric potential indicating a low level may be applied to the common electrode as the final pulse of the third pulse signal. At this time, even if the black particles which are not easily noticeable are spread, it does not look as if the black particles are spread to the area of the adjacent pixels, which improves visual quality.

(3) In the driving method of the electrophoretic display device, the third width may be equal to the first width in the third pulse application.

(4) In the driving method of the electrophoretic display device, the third width may be shorter than the first width in the third pulse application.

With these configurations, the third width in the third pulse application may be determined on the basis of the relationship with the first width in the first pulse application. For example, the third width may be equal to the first width. In this case, since the pulse width of the first electric potential can be commonly used in the first pulse application and the third pulse application, it is possible to reduce a circuit size. Further, if the pulse width of the second electric potential is common, it is possible to further reduce the circuit size. Further, for example, the third width may be shorter than the first width. In this case, it is possible to terminate the third pulse application early, thereby making it possible to reduce a processing time of the rewriting.

(5) Another aspect of the invention is directed to an electrophoretic display device including: a display section in which an electrophoretic element including electrophoretic particles is disposed between a pair of substrates and a plurality of pixels capable of displaying at least a first color and a second color is arranged; and a control section which controls the display section. Here, the display section includes: a pixel electrode which is formed between one of the substrates and the electrophoretic element to correspond to each pixel;

and a common electrode which is formed between the other one of the substrates and the electrophoretic element to face the plurality of pixel electrodes. The control section performs an image rewriting control for rewriting an image displayed on the display section by applying a voltage based on a driving pulse signal, in which a first electric potential and a second electric potential are repeated, to the common electrode, by applying any one of the first electric potential, the second electric potential and the voltage based on the driving pulse signal to each of the plurality of pixel electrodes, and by moving the electrophoretic particles by an electric field generated between the pixel electrodes and the common electrode. In the image rewriting control, the control section performs: a first pulse application control for using the driving pulse signal with the pulse width of the first electric potential being a first width; a second pulse application control for using the driving pulse signal with the pulse width of the first electric potential being a second width longer than the first width, after the first pulse application control; and a third pulse application control for using the driving pulse signal with the pulse width of the first electric potential being a third width shorter than the second width, after the second pulse application control.

According to this aspect of the invention, since the control section sequentially performs the first pulse application control, the second pulse application control and the third pulse application control as the image rewriting control, it is possible to clearly display fine lines, patterns and shapes while performing a high contrast display by suppressing occurrence of flickering.

Firstly, in a section where flickering occurs if a voltage based on the second pulse signal is applied, the first pulse application control is performed. In the first pulse application control, since the voltage based on the first pulse signal in which the pulse width of the first electric potential is shorter compared with the second pulse signal is applied, a rapid color change is suppressed to prevent flickering. Then, in a section where flickering does not occur even if a voltage based on the second pulse signal is applied, the second pulse application control is performed, and thus, the voltage based on the second pulse signal is applied to the common electrode. The pulse width of the second pulse signal is sufficiently long such that the electrophoretic particles can be sufficiently moved to obtain a desired reflectance. Thus, it is possible to enhance the contrast. On the other hand, there is a possibility that the electrophoretic particles may move to a display area of an adjacent pixels along an electric field in an inclined direction due to the long pulse width to blur a displayed image. Thus, the third pulse application control is performed to return the electrophoretic particles which are spread to the display area of the adjacent pixels to the vicinity of a central boundary line with respect to the adjacent pixels.

It is possible to suppress occurrence of flickering through the first pulse application control and the second pulse application control, to thereby achieve a high contrast display. Further, it is possible to clearly display fine lines, patterns and shapes through the third pulse application process.

(6) In the electrophoretic display device, the electrophoretic particles may include a first electrophoretic particle which displays the first color and a second electrophoretic particle which displays the second color. Further, in the third pulse application control, the control section may use the driving pulse signal which displays the first color to terminate driving of the common electrode in a case where the diameter of the second electrophoretic particle is larger than the diameter of the first electrophoretic particle, and may use the driving pulse signal which displays the second color to terminate driving of the common electrode in a case where the diameter of the second electrophoretic particle is equal to or smaller than the diameter of the first electrophoretic particle.

The color of the particles of a large diameter is easily noticeable in the display section. Thus, in a case where the color of the large diameter particles is spread by the final pulse, even though the color of the large diameter particles is present in the vicinity of the central boundary line without intrusion into the display area of the adjacent pixel, the color of the large diameter particles is easily noticeable. Thus, it seems that the color of the large diameter particles is spread to the area of the adjacent pixels.

With the above-described configuration, the above problem is solved by driving the final pulse in the third pulse application control so that the color of the electrophoretic particles of the small diameter is displayed, to thereby improve visual quality to clearly display fine lines, patterns and shapes.

(7) In the electrophoretic display device, the control section may set the third width to be equal to the first width in the third pulse application control.

(8) In the electrophoretic display device, the control section may set the third width to be shorter than the first width in the third pulse application control.

With these configurations, the third width in the third pulse application control may be determined on the basis of the relationship with the first width in the first pulse application control. For example, the third width may be equal to the first width. In this case, since the pulse width of the first electric potential can be commonly used in the first pulse application control and the third pulse application control, it is possible to reduce a circuit size. Further, if the pulse width of the second electric potential is common, it is possible to further reduce the circuit size. Further, for example, the third width may be shorter than the first width. In this case, it is possible to terminate the third pulse application control early, thereby making it possible to reduce a processing time of the entire image rewriting control.

(9) Still another aspect of the invention is directed to an electronic apparatus including the electrophoretic display device as described above.

According to this aspect of the invention, since the electronic apparatus includes the electrophoretic display device in which the control section sequentially performs the first pulse application control, the second pulse application control and the third pulse application control as the image rewriting control, it is possible to provide an electronic apparatus which is capable of clearly displaying fine lines, patterns and shapes while performing a high contrast display by suppressing occurrence of flickering.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
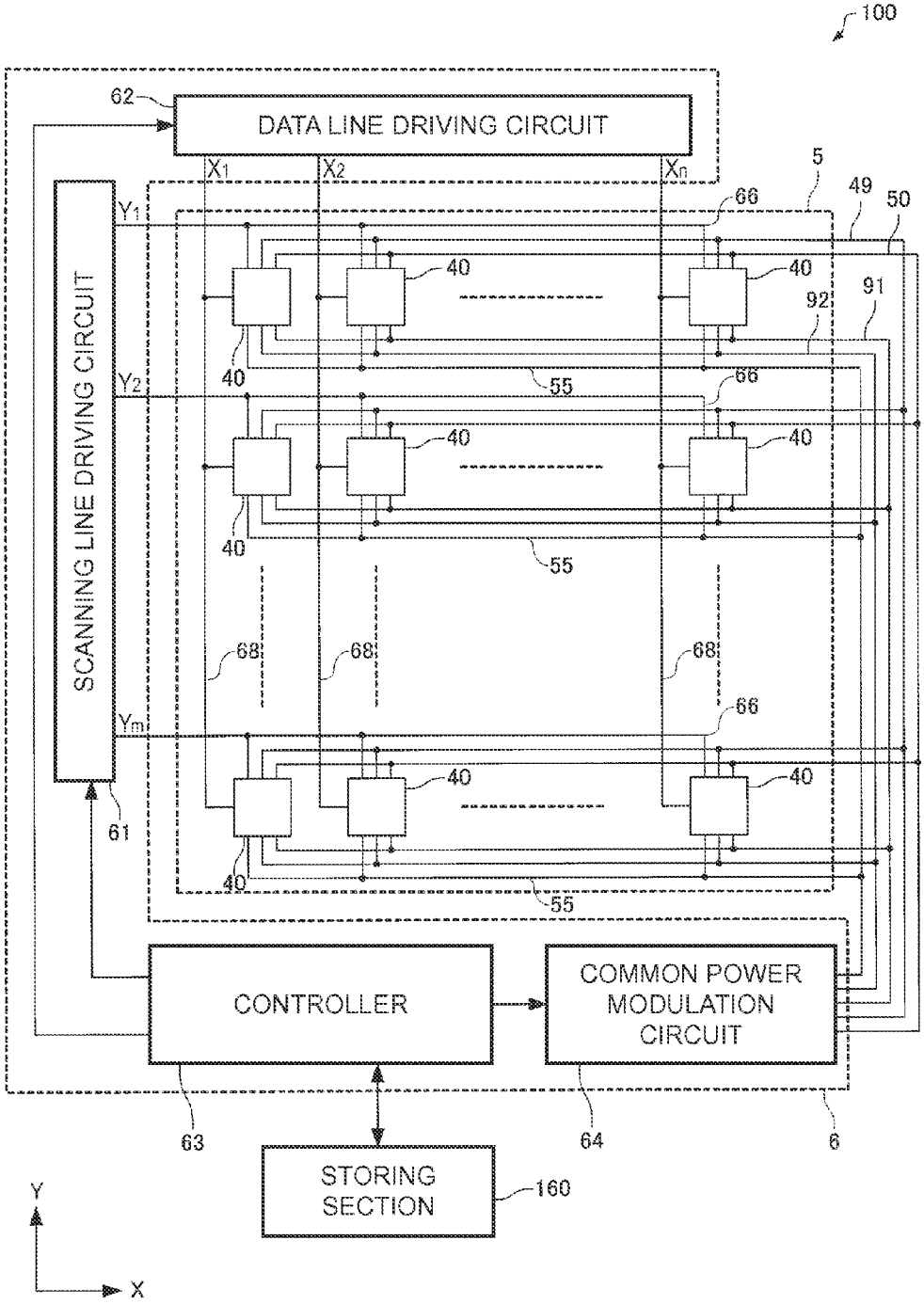
FIG. 1 is a block diagram illustrating an electrophoretic display device according to a first embodiment.

Hereinafter, embodiments of the invention will be described with reference to the accompanying drawings. With regard to a modification and an application example, the same reference numerals are given to the same configuration as in a first embodiment, and detailed description thereof will be omitted.

1. First Embodiment

The first embodiment of the invention will be described with reference to FIG. 1 to FIG. 8D.

1.1. Electrophoretic Display Device 1.1.1. Configuration of Electrophoretic Display Device FIG. 1 is a block diagram illustrating an electrophoretic display device of an active matrix drive type according to the present embodiment.

The electrophoretic display device 100 includes a control section 6, a storing section 160 and a display section 5. The control section 6 controls the display section 5, and includes a scanning line driving circuit 61, a data line driving circuit 62, a controller 63, and a common power modulation circuit 64. The scanning line driving circuit 61, the data line driving circuit 62, and the common power modulation circuit 64 are connected to the controller 63, respectively. The controller 63 generally controls these sections on the basis of image signals or the like read from the storing section 160 or sync signals supplied from the outside. The control section 6 may be configured to include the storing section 160. For example, the storing section 160 may be a memory which is built into the controller 63.

Here, the storing section 160 may be an SRAM, a DRAM or a different memory, and stores at least data (image signals) about images displayed on the display section 5. Further, information to be controlled by the controller 63 may be stored in the storing section 160.

A plurality of scanning lines 66 which extends from the scanning line driving circuit 61 and a plurality of data lines 68 which extends from the data line driving circuit 62 are formed in the display section 5, and a plurality of pixels 40 is formed to correspond to intersections thereof.

The scanning line driving circuit 61 is connected to respective pixels 40 by m scanning lines 66 ($Y_1, Y_2, \ldots, Y_m$). By sequentially selecting the scanning lines 66 from the first line to the m-th line under the control of the controller 63, the scanning line driving circuit 61 supplies a selection signal which regulates an on-timing of a driving TFT 41 (see FIG. 2) which is disposed in a pixel 40.

The data line driving circuit 62 is connected to the respective pixels 40 by n data lines 68 ($X_1, X_2, \ldots, X_n$). The data line driving circuit 62 supplies, to the pixel 40, an image signal which regulates image data of one bit corresponding to each of the pixels 40, under the control of the controller 63. In the present embodiment, if image data "0" is regulated, an image signal of a low level is supplied to the pixel 40, and if image data "1" is regulated, an image signal of a high level is supplied to the pixel 40.

A low electric potential power line 49 (Vss), a high electric potential power line 50 (Vdd), a common electrode wiring 55 (Vcom), a first pulse signal line 91 ($S_1$) and a second pulse signal line 92 ($S_2$), which extend from the common power modulation circuit 64, are disposed in the display section 5. The respective wirings are connected to the pixel 40. The common power modulation circuit 64 generates a variety of signals which are supplied to the respective wirings under the control of the controller 63, and also performs electric connection and disconnection of the respective wirings (high impedance, Hi-Z).

1.1.2. Circuit Configuration of Pixel Portion

Figure 2:
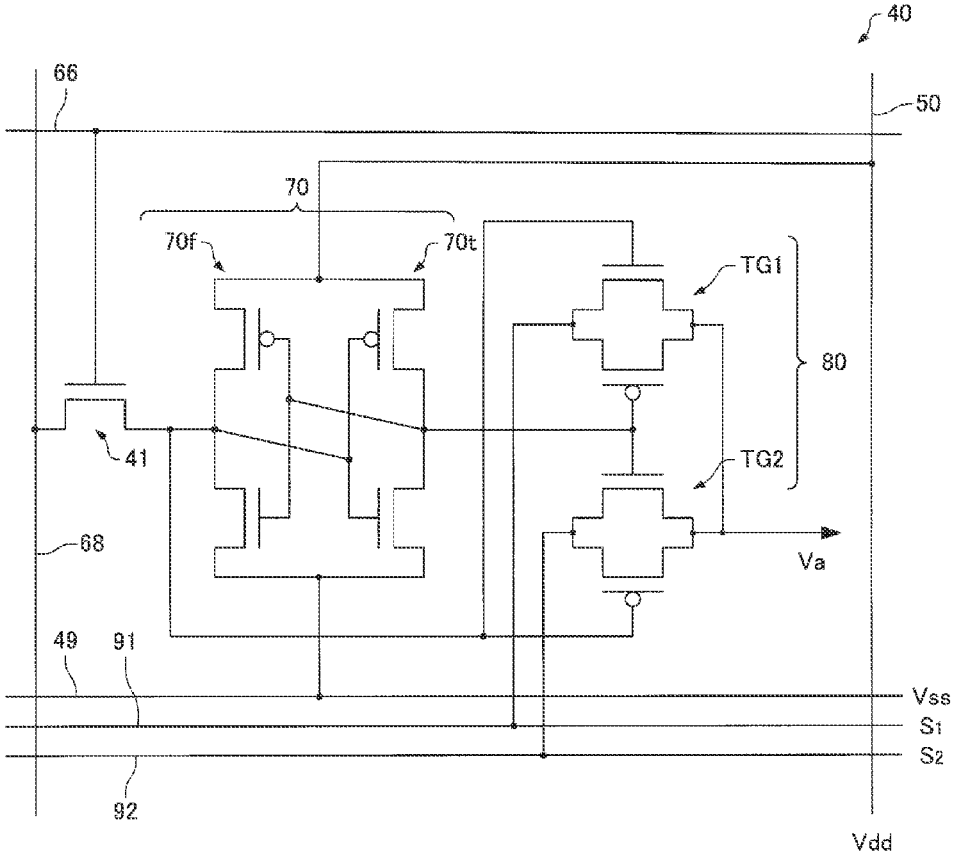
FIG. 2 is a diagram illustrating a configuration example of a pixel of the electrophoretic display device according to the first embodiment.

FIG. 2 is a diagram illustrating a circuit configuration of the pixel 40 in FIG. 1. The same reference numerals are given to the same wirings as in FIG. 1, and detailed description thereof will be omitted. Further, description of the common electrode wirings 55 which are common in all pixels will be omitted.

The driving TFT (Thin Film Transistor) 41, a latch circuit 70, and a switch circuit 80 are disposed in the pixel 40. The pixel 40 has a configuration of an SRAM (Static Random Access Memory) type which holds an image signal as an electric potential by the latch circuit 70.

The driving TFT 41 is a pixel switching element including an N-MOS transistor. Agate terminal of the driving TFT 41 is connected to the scanning line 66, and a source terminal thereof is connected to the data line 68. Further, a drain terminal thereof is connected to a data input terminal of the latch circuit 70. The latch circuit 70 includes a transfer inverter 70*t* and a feedback inverter 70*f*. Power voltage is supplied to the inverters 70*t* and 70*f* from the low electric potential power line 49 (Vss) and the high electric potential power line 50 (Vdd).

The switch circuit 80 includes transmission gates TG1 and TG2, and outputs a signal to a pixel electrode 35 (see FIGS. 3B and 3C) according to the level of the pixel data stored in the latch circuit 70. Here, "Va" represents an electric potential (signal) supplied to the pixel electrode of one pixel 40.

If the image data "1" (image signal of the high level) is stored in the latch circuit 70 and the transmission gate TG1 is turned on, the switch circuit 80 supplies a signal S1 as Va. On the other hand, if the image data "0" (image signal of the low level) is stored in the latch circuit 70 and the transmission gate TG2 is turned on, the switch circuit 80 supplies a signal S2 as Va. With such a circuit configuration, the control section 6 can control the electric potential (signal) supplied to the pixel electrode of each pixel 40. The circuit configuration of the pixel 40 is an example, and thus is not limited to that shown in FIG. 2.

1.1.3. Display Method

The electrophoretic display device 100 according to the present embodiment employs an electrophoretic method of a two-particle system microcapsule type. If a dispersion liquid is colorless and transparent and electrophoretic particles are black or white, at least two colors can be displayed using two colors of black and white as base colors. Here, it is assumed that the electrophoretic display device 100 displays black as a first color and displays white as a second color. Further, displaying a pixel which displays black (the first color) with white (the second color) and displaying a pixel which displays white with black are referred to as inversion.

Figure 3A:
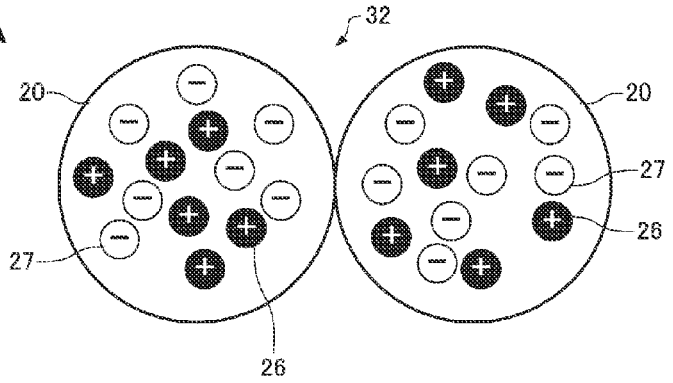
FIG. 3A is a diagram illustrating a configuration example of an electrophoretic element.

FIG. 3A is a diagram illustrating a configuration of an electrophoretic element 32 according to the present embodiment. The electrophoretic element 32 is disposed between a device substrate 30 and an opposing substrate 31 (see FIGS. 3B and 3C). The electrophoretic element 32 has a configuration in which a plurality of microcapsules 20 is arranged. The microcapsule 20 includes, for example, a colorless and transparent dispersion liquid, a plurality of white particles (electrophoretic particles) 27, and a plurality of black particles (electrophoretic particles) 26. In the present embodiment, for example, it is assumed that the white particles 27 are negatively charged and the black particles 26 are positively charged.

Figure 3B:
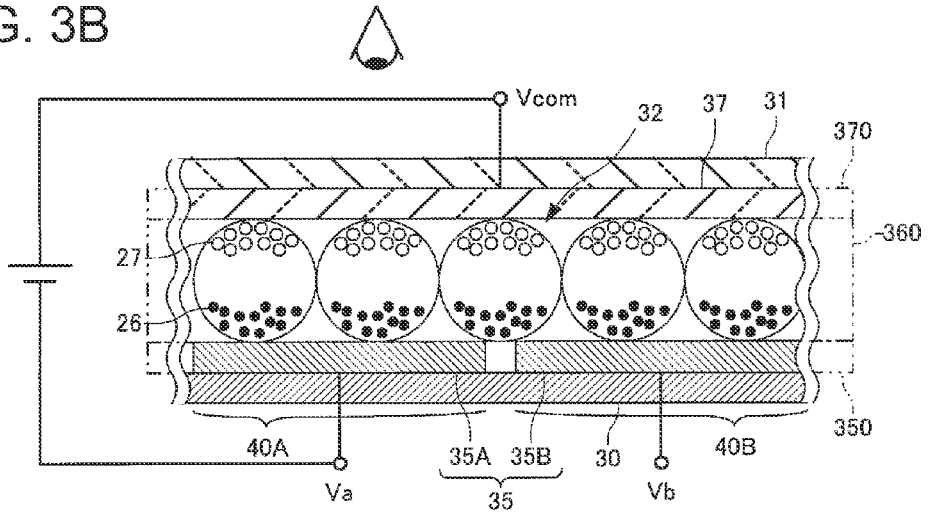
FIGS. 3B and 3C are diagrams illustrating an operation of the electrophoretic element.

FIG. 3B is a partial cross-sectional diagram of the display section 5 of the electrophoretic display device 100. The device substrate 30 and the opposing substrate 31 support therebetween the electrophoretic element 32 in which the microcapsules 20 are arranged. The display section 5 includes a driving electrode layer 350 which includes a plurality of pixel electrodes 35, on a side of the device substrate 30 which faces the electrophoretic element 32. In FIG. 3B, the pixel electrode 35A and the pixel electrode 35B are shown as the pixel electrodes 35. It is possible to supply an electric potential to each pixel by the pixel electrode 35 (for example, Va or Vb). Here, a pixel which has the pixel electrode 35A is referred to as a pixel 40A, and a pixel which has the pixel electrode 35B is referred to as a pixel 40B. The pixel 40A and the pixel 40B are two pixels which correspond to the pixel 40 (see FIGS. 1 and 2).

On the other hand, the opposing substrate 31 is a transparent substrate, and an image is displayed on the side of the opposing substrate 31 in the display section 5. The display section 5 includes a common electrode layer 370 which includes a planar common electrode 37, on a side of the facing substrate 31 which faces the electrophoretic element 32. The common electrode 37 is a transparent electrode. The common electrode 37 is an electrode which is common to all pixels, differently from the pixel electrode 35, and is supplied with an electric potential Vcom.

The electrophoretic element 32 is disposed in an electrophoretic display layer 360 which is disposed between the common electrode layer 370 and the driving electrode layer 350, and the electrophoretic display layer 360 forms a display area. According to an electric potential difference between the common electrode 37 and the pixel electrode (for example, 35A or 35B), it is possible to display a desired color for each pixel.

In FIG. 3B, the electric potential Vcom on the common electrode side is an electric potential which is higher than an electric potential Va of the pixel electrode of the pixel 40A. At this time, since the white particles 27 which are negatively charged are pulled to the side of the common electrode 37, and the black particles 26 which are positively charged are pulled to the side of the common electrode 35A, the pixel 40A displays white.

Figure 3C:
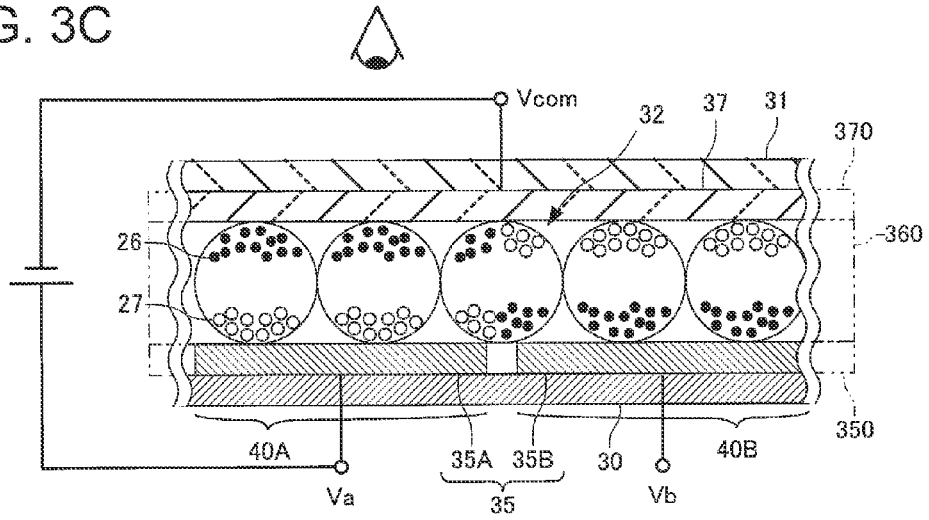

In FIG. 3C, the electric potential Vcom on the common electrode side is an electric potential which is lower than the electric potential Va of the pixel electrode of the pixel 40A. At this time, contrarily, since the black particles 26 which are positively charged are pulled to the side of the common electrode 37, and the white particles 27 which are negatively charged are pulled to the side of the common electrode 35A, when viewed, the pixel 40A displays black. Since the configuration of FIG. 3C is the same as that of FIG. 3B, description thereof will be omitted. Further, in FIGS. 3B and 3C, Va, Vb and Vcom are described as fixed electric potentials, but in reality, Va, Vb and Vcom are pulse signals in which their electric potentials are changed with time.

1.2. Driving Method of Electrophoretic Display Device 1.2.1. Problems in a Fine Display Here, a driving method of an electrophoretic display device, which performs a first pulse application process of adding a first pulse signal to the common electrode and a second pulse application process of adding a second pulse signal of which the pulse width is longer than that of the first pulse signal to the common electrode, is referred to as a comparative example (JP-A-2009-134245). In the comparative example, the occurrence of flickering is suppressed to thereby perform a high contrast display, but it has been experimentally confirmed that such a phenomenon occurs in which a color displayed by a final pulse is spread to a display area of adjacent pixels which display a different color. This phenomenon is seen at a normal temperature (for example, 25° C.), but particularly, it is noticeable at a high temperature (for example, 50° C.) where electrophoretic particles are easily moved.

In the electrophoretic display device, such a display performance in which an image can be clearly displayed by a fine line having, for example, a width of one or two pixels has been demanded. The width of one or two pixels corresponds to about 85 to 170 μm, for example. Further, in the driving method relating to the comparative example, there is a possibility that a fine line is faint by the spreading to the adjacent pixels or visual quality is deteriorated. Thus, in the present embodiment, this problem is solved by modifying the comparative example. Hereinafter, a specific example of this problem will be described with reference to FIGS. 4A to 4C.

Figure 4A:
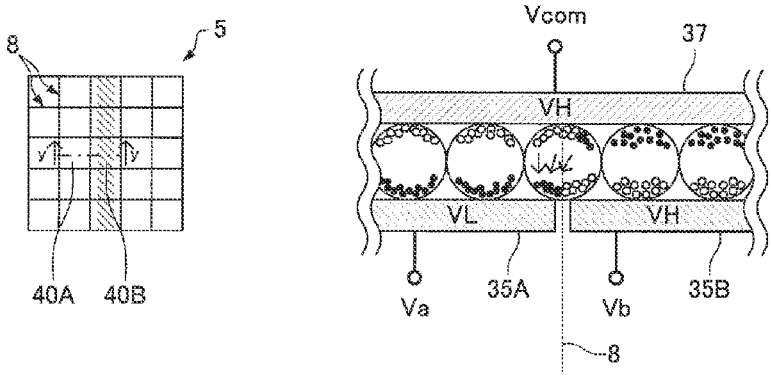
FIGS. 4A and 4B are diagrams illustrating display examples which cause problems and cross-sectional diagrams thereof which are cut along line y-y.
Figure 4B:
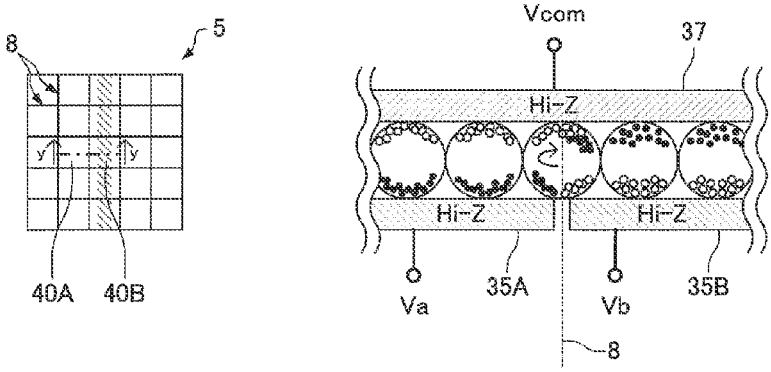
Figure 4C:
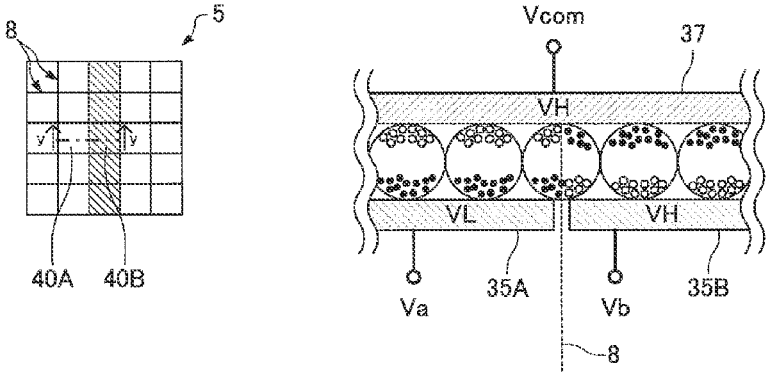
FIG. 4C is a diagram illustrating a display example which is improved and a cross-sectional diagram thereof which is cut along line y-y.

FIGS. 4A and 4B illustrate examples of color spreading according to the comparative example, and FIG. 4C illustrates an example in which the visual quality is enhanced according to the present embodiment. FIGS. 4A to 4C illustrate display examples (left figures) of a black line which has a line width of one pixel in an area of 5×5 pixels in the display section 5, and cross-sectional diagrams (right figures) along line y-y. A central boundary line 8 is a line obtained by connecting the centers of gaps between the pixel electrodes in each of a row direction and a column direction. In other words, the central boundary line 8 is a line indicating the boundary in the row direction and the column direction when each pixel is given the same area. Hatched lines in the left figures of FIGS. 4A to 4C represent black color displays. Further, the pixels 40A and 40B adjacent to line y-y are shown in FIGS. 4A to 4C.

In the right figures of FIGS. 4A and 4C, Va and Vb represent signals (electric potentials) supplied to the pixel electrode 35A of the pixel 40A and the pixel electrode 35B of the pixel 40B, respectively. Vcom is a signal supplied to the common electrode 37. A circuit configuration of the pixel 40A and the pixel 40B is the same as that of FIG. 2, and $S_1$ or $S_2$ are output as Va and Vb, according to image data stored in each latch circuit. The respective signals Va, Vb and Vcom may have a high level (VH), a low level (VL) or a high impedance state (Hi-Z).

FIG. 4A illustrates a state when a final pulse is given in a second pulse application process of the comparative example. In the comparative example, the driving is stopped thereafter (high impedance state), and its state is as shown in FIG. 4B. In FIG. 4A, Vcom (=VH) in which a white color display is performed is supplied to the common electrode 37; an electric field in which white particles are pulled toward the side of the common electrode 37 between the common electrode 37 and the pixel electrode 35A to which Va (=VL) of a low level is supplied is generated. An electric field is not generated between the common electrode 37 and the pixel electrode 35B to which the same electric potential Vb (=VH) is supplied.

Here, attention will be focused on a microcapsule in the center of FIG. 4A. The electric field generated between the common electrode 37 and the pixel electrode 35A is generated in a vertical direction where these electrodes are connected with each other in the shortest distance, and also in an inclined direction (arrow in FIG. 4A). Since the width of the pulse in the second pulse application process including the final pulse becomes long, for example, compared with the first pulse application process, the time when the electric field in the inclined direction works in the electrophoretic particles becomes long. Thus, on the side of the pixel 40B which is beyond the central boundary line 8, the white particles are pulled toward the common electrode 37, and thus, it seems that the display area of white color is spread. Accordingly, as shown in the left figure of FIG. 4A, it seems that the black line which has the line width of one pixel, which is partitioned by the central boundary line 8, is narrowed in width leading to faintness due to the spread white color.

Further, as shown in the right figure of FIG. 4B, in the comparative example, thereafter, it becomes the high impedance state. At this time, since the width of the pulse in the second pulse application process becomes long, the movement amount of the electrophoretic particles is large. Thus, even in the high impedance state, the display area of the color (here, white) displayed by the final pulse tends to be further spread due to convection flow of the dispersion liquid. Then, as shown in the left figure of FIG. 4B, there is a concern that the fine line may be faintly displayed.

Thus, in the present embodiment, without increasing the time when the electric field in the inclined direction works in the electrophoretic particles, the movement amount of the electrophoretic particles is decreased to suppress the influence of the convection flow of the dispersion liquid, to then enter the driving stop state. Thus, the problem in the comparative example is solved, and the electrophoretic particles are not beyond the central boundary line 8 as shown in the right figure of FIG. 4C, and thus, it is possible to clearly perform display using a line of the one pixel line width as shown in the left figure of FIG. 4C. Hereinafter, the driving method of the electrophoretic display device according to the present embodiment will be described with reference to FIGS. 5A and 5B.

1.2.2. Flowchart

Figure 5A:
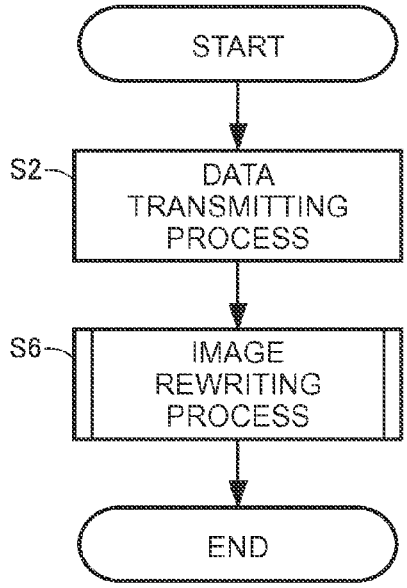
FIGS. 5A and 5B are flowcharts illustrating a driving method of the first embodiment.

FIG. 5A is a flowchart of a main routine illustrating the driving method of the electrophoretic display device according to the first embodiment.

When the controller 63 rewrites an image to be displayed on the display section 5, firstly, the controller 63 performs a data transmitting process of obtaining an image signal from the storing section 160 and controlling the scanning line driving circuit 61 and the data line driving circuit 62 to transmit the data to each pixel (S2).

Next, the controller 63 performs an image rewriting process of rewriting the image to be displayed on the display section 5 on the basis of the image signal by the common power conversion circuit 64 (S6). In the image rewriting process, in order to perform a high contrast display by suppressing flickering and to clearly display fine lines, patterns and shapes, the following sub routine flowchart is given.

Figure 5B:
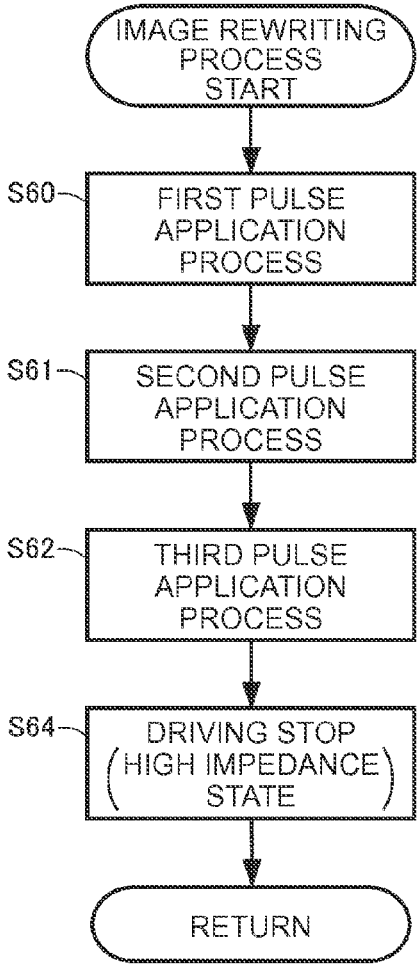

FIG. 5B is a flowchart of a sub routine of the image rewriting process S6 in the first embodiment. In the present embodiment, the image rewriting process step S6 includes a first pulse application process S60, a second pulse application process S61, a third pulse application process S62 and a driving stop S64.

In the first pulse application process S60, if a voltage based on the second pulse signal is applied, a voltage based on the first pulse signal is applied to the common electrode in a section where flickering is noticeable. The first pulse signal has a pulse width of the first electric potential which is shorter than that of the second pulse signal. Thus, in the first pulse application process S60, the color change width is small and flickering can be suppressed. The section where flickering is noticeable may be determined as a front half of the image rewriting process, or for example, may be a section where a reflectance reaches about 80% of a desired reflectance indicating black or white. The first electric potential is a high level (VH) or a low level (VL), which is appropriately selected by a driving method (which will be described later). For example, in a case where full driving is performed, since a driving pulse signal in which VH and VL are repeated at the same interval is used, the first electric potential may be any one of VH and VL.

In the second pulse application process S61, a voltage based on the second pulse signal in a section where flickering is not noticeable is applied to the common electrode. According to the second pulse signal having a long pulse length, the time when the electric field works in the electrophoretic particles becomes long, to thereby obtain a reflectance which is close to a desired reflectance.

The third pulse application process S62 is a process for clearly displaying the fine lines, patterns and shapes. In S62, after the second pulse application process S61, a voltage based on a third pulse signal is applied to the common electrode. As described above, if the driving is stopped after the second pulse application process S61, the color displayed by the final pulse is spread to the display area of the adjacent pixels which display a different color. Thus, it is difficult to clearly display a fine line. In the third pulse application process S62, since a voltage based on a third pulse signal which has the pulse width of the first electric potential which is shorter than that of the second pulse signal is applied to the common electrode and the driving is stopped thereafter, it is possible to clearly display fine lines or the like. That is, since the time when the electric field works in the electrophoretic particles is short in the third pulse signal, the movement of the electrophoretic particles along the electric field in the inclined direction is small. Thus, it is possible to suppress the color displayed by the final pulse from being spread to the display area of the adjacent pixels.

Further, in the present embodiment, the driving stop S64 is performed after the third pulse application process S62. At this time, since there is not a large amount of movement of the electrophoretic particles in the third pulse signal, the influence of the convection flow of the dispersion liquid is small, and thus, the clear display of fine lines, patterns and shapes are easily maintained.

1.2.3. Example of Waveform Diagram and Color Change

Figure 6A:
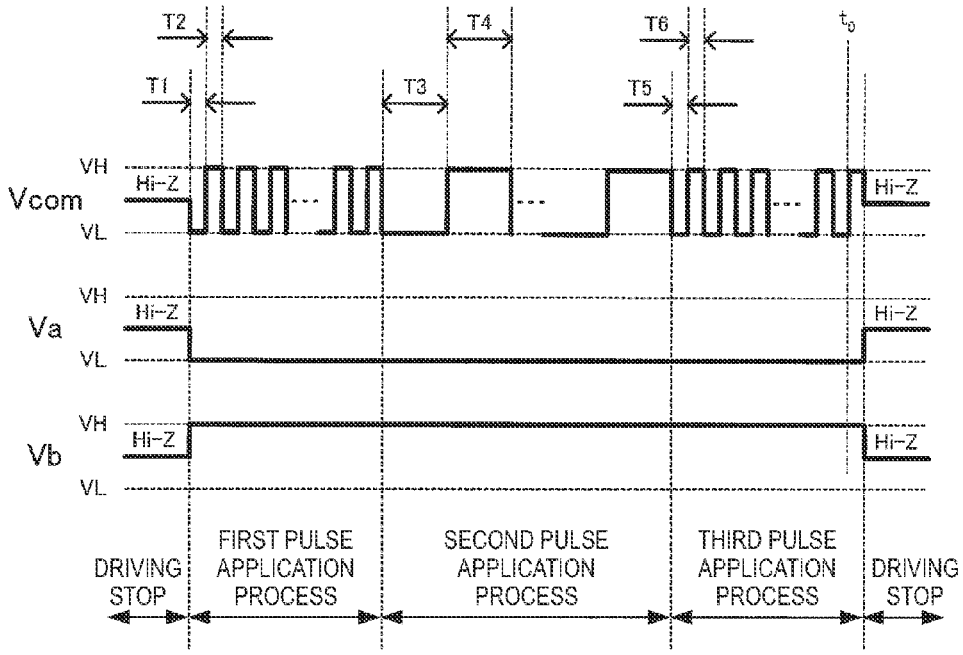
FIGS. 6A and 6B are diagrams illustrating the driving method of the first embodiment.
Figure 6B:
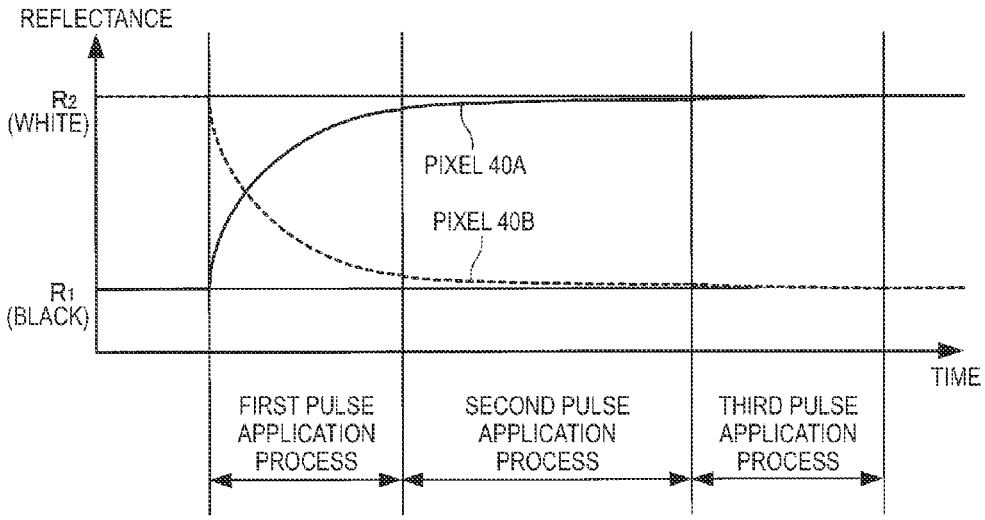

FIGS. 6A and 6B illustrate an example when the full driving is performed by the driving method according to the first embodiment. In the figures, since Va, Vb, Vcom, VH and VL are the same as those of FIG. 3A to FIG. 4C, detailed descriptions thereof will be omitted.

FIG. 6A is a waveform diagram illustrating a case where the pixel 40A is changed from black to white and the pixel 40B is changed from white to black, by the driving method of the electrophoretic display device according to the first embodiment. In FIG. 6A, Va is at the low level (VL) through the image rewriting process, and Vb is at the high level (VH). Further, Vcom repeats VL and VH at the same time interval in each of the first to third pulse application processes. That is, in FIG. 6A, the relationships of T1=T2, T3=T4 and T5=T6 are established, differently from reverse potential driving (which will be described later), the first electric potential may be VL or VH. In this example, assuming that the first electric potential is VL, T1 (first width), T3 (second width), and T5 (third width) will be described.

In the first pulse application process, T1 (first width) of the first pulse signal should be short so that flickering is not noticeable. Here, if T1 is excessively short, since a long time is taken for the first pulse application process, for example, T1 is set to 20 ms.

In the second pulse application process, T3 (second width) of the second pulse signal is a value larger than T1 (first width). For example, T3 is set to 200 ms so that the electrophoretic particles are moved until a sufficient reflectance is obtained.

In the third pulse application process, T5 (third width) of the third pulse signal is a value smaller than T3 (second width). Here, the third pulse application process is a process of returning the electrophoretic particles which are spread to the display area of the adjacent pixels to the vicinity of the central boundary line with respect to the adjacent pixels. The movement amount of the electrophoretic particles in the present process is small. Accordingly, T5 may have a pulse width which is equal to or smaller than that of T1. For example, T5 is set to 20 ms. At this time, T1=T5=20 ms, and thus, the size of the circuit which generates pulses can be reduced. In another example, T5 may be set to 10 ms. At this time, it is possible to terminate the third pulse application process early, and to reduce the processing time of the entire image rewriting process.

In the first to third pulse application processes, the repetition numbers of the driving pulse signals may be twenty in the first pulse signal, two in the second pulse signal, and ten in the third pulse signal. According to an experimental result, there is not a significant change even though the repetition numbers of the driving pulse signals are larger than these numbers in the first to third pulse application processes.

FIG. 6B is a diagram illustrating color change of the pixel 40A and the pixel 40B according to the example in FIG. 6A. Firstly, in the first pulse application process, a reflectance is changed to about 80% of a desired color reflectance without causing flickering. Further, in the second pulse application process, the reflectance is changed to reach an approximately desired color by the second pulse signal having the long pulse width, to thereby obtain high contrast. Further, in the third pulse application process, the fine lines, patterns and shapes are clearly displayed by the third pulse signal having the short pulse width.

1.2.4. Problem in a Case where the Diameters of Electrophoretic Particles are Significantly Different In the above-described example, the electrophoretic particles (black particles) which display black and the electrophoretic particles (white particles) which display white have approximately the same diameters (see FIG. 3A). However, the diameters may be significantly different in reality. For example, in a case where the diameter of the microcapsule is about 30 μm, the diameters of the black particles may be 10 to 30 nm, the diameters of the white particles may be 100 to 300 nm. Thus, the white particles may be 10 times larger than the black particles.

Figure 7A:
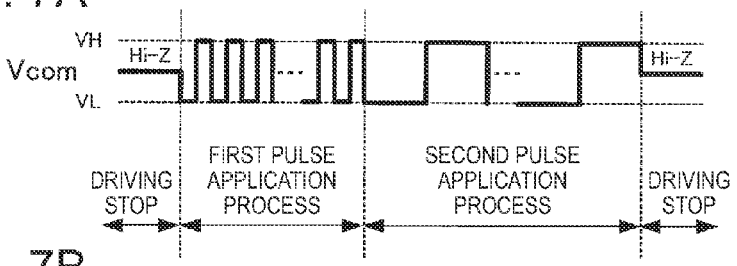
FIGS. 7A to 7D are waveform diagrams of the driving method of the electrophoretic display device.
Figure 7B:
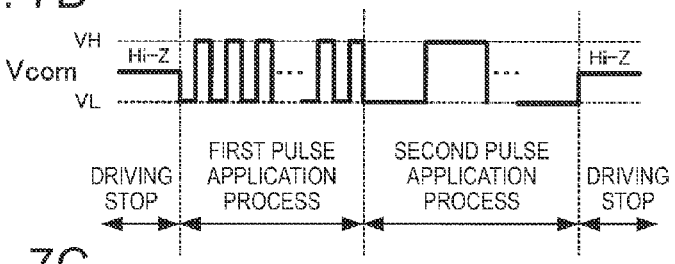
Figure 7C:
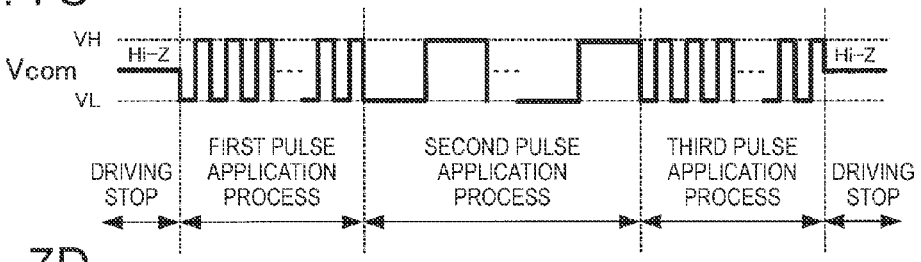
Figure 7D:
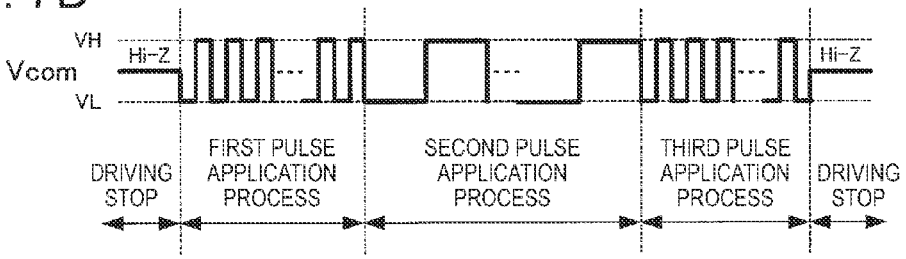
Figure 7E:
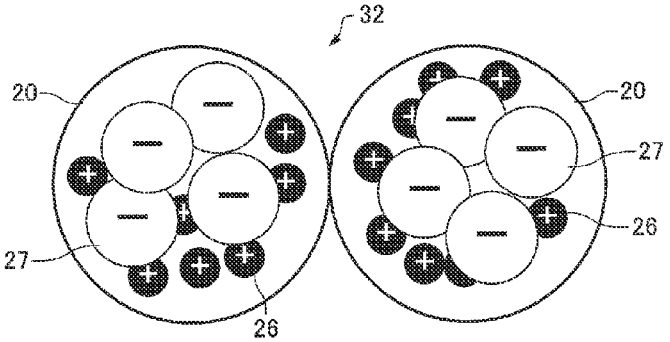
FIG. 7E is a diagram illustrating an actual configuration example of the electrophoretic element.

At this time, as shown in FIG. 7E, white is easily noticeable in the display section. This is because the black particles may be inserted into gaps between the white particles and even one white particle may occupy a large display area corresponding to the plurality of small diameter particles which are gathered together. Symbols and the like in FIG. 7E are the same as those of FIG. 3A, and descriptions thereof will be omitted.

However, even in such a case, it is possible to use the driving method according to the first embodiment without significantly changing the driving pulse signal, and to clearly display the fine lines, patterns and shapes.

1.2.5. Comparison in a Case where Driving Pulse Signal is Changed

A case will be described where the electrophoretic display device including the electrophoretic element 32 in which the white particles are large as shown in FIG. 7E is driven using the driving method according to the first embodiment and the comparative example. Here, change in visual quality of a two-pixel checkered pattern according to change in the final pulse supplied directly before the driving stop will be described with reference to FIGS. 7A to 7D, and FIGS. 8A to 8D. The two-pixel checkered pattern is a checkered pattern in which a black or white square is displayed by 2×2 pixels. In this example, a case where the final pulse displays black is referred to as "black writing" and a case where the final pulse displays white is referred to as "white writing". Further, the same reference numerals are given to the same elements as in FIG. 1 to FIG. 6B, and descriptions thereof will be omitted.

FIG. 7A is a waveform illustrating a case where the white writing is performed according to the comparative example. The pixel electrode is supplied with any one of VH and VL, like Va or Vb in FIG. 6A, which is omitted in FIGS. 7A to 7D. In the comparative example, since the driving is stopped after the second pulse application process, the finally written white color is widely spread.

Figure 8A:
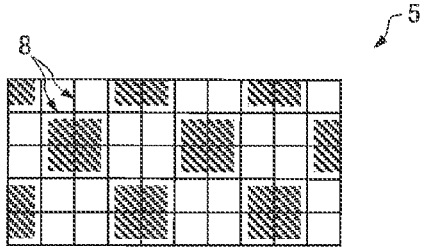
FIGS. 8A to 8D are diagrams illustrating display examples of a two-pixel checkered pattern.

FIG. 8A is a display example of the two-pixel checkered pattern according to the driving method in FIG. 7A. The white color is widely spread to the display area of the adjacent pixels due to the electric field in the inclined direction or the convection of the dispersion liquid. In this case, it is difficult to display fine shapes, and particularly, the visual quality of the black display portion is deteriorated.

FIG. 7B is a waveform illustrating a case where the black writing is performed according to the comparative example. Differently from FIG. 7A, the driving pulse signal is terminated at VL. In the comparative example, since the driving is stopped after the second pulse application process, the finally written black color is widely spread.

Figure 8B:
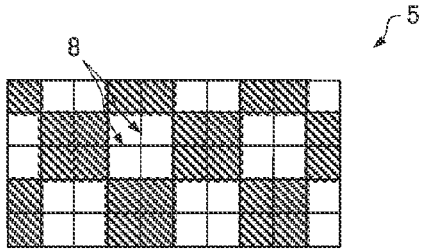

FIG. 8B is a display example of the two-pixel checkered pattern according to the driving method in FIG. 7B. The black color is widely spread to the display area of the adjacent pixels due to the electric field in the inclined direction or the convection of the dispersion liquid. However, since the white color is noticeable in display, the spreading of the black color seems to be smaller than the white color in FIG. 8A. Nevertheless, it is difficult to display fine shapes, and particularly, the visual quality of the white display portion is deteriorated.

FIG. 7C is a waveform illustrating a case where the white writing is performed according to the driving method of the present embodiment. At this time, the waveform is the same as that of FIG. 6A. Since the driving is stopped after the third pulse application process, the spreading of the finally written white color is suppressed.

Figure 8C:
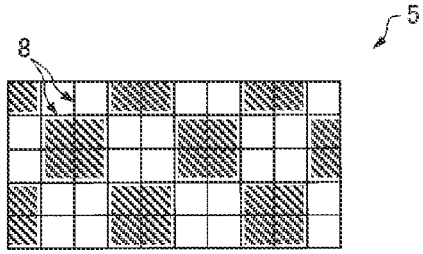

FIG. 8C is a display example of the two-pixel checkered pattern according to the driving method of FIG. 7C. Compared with FIG. 8A, improvement is achieved by the driving method of the present embodiment including the third pulse application process. However, since the white particles spread in the vicinity of the central boundary line 8 is noticeably displayed, a user feels that the white color is spread. Thus, in a case where the white particles are large, it is preferable to perform the following driving method.

FIG. 7D is a waveform diagram illustrating a case where the black writing is performed according to the driving method of the present embodiment. At this time, the waveform is the same as the driving stop at a time t0 in FIG. 6A.

Figure 8D:
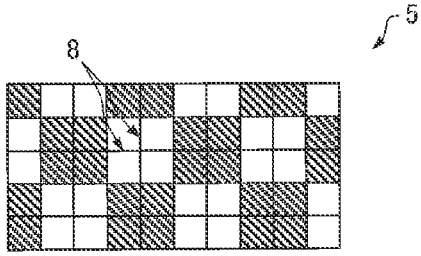

FIG. 8D is a display example of the two-pixel checkered pattern according to the driving method of FIG. 7D. The black particles are spread in the vicinity of the central boundary line 8 by the black writing, but since the black particles are not noticeably displayed, it does not seem that the black particles are spread to the adjacent pixels. Thus, compared with FIGS. 8A to 8C, the visual quality is improved, and thus, the fine pattern is clearly displayed.

As described above, in the present embodiment, since the color represented by the electrophoretic particles having the small diameters is displayed by the final pulse, it is possible to clearly display the fine lines, patterns, and shapes with good visual quality.

2. Modifications and Application Examples

Modifications and application examples of the first embodiment of the invention will be described with reference to FIG. 9A to FIG. 11B.

2.1. Modifications

2.1.1. Reverse Electric Potential Driving Pulse

In the electrophoretic display device, in order to increase the response speed, in addition to full driving for drawing in the entire display section, partial driving for drawing in only a part of the display section which is a rewriting target may be performed. In the above-described embodiment, the full driving is described, but the driving method of the first embodiment may be applied to the partial driving. At this time, a signal which includes a reverse electric potential driving pulse may be used.

Figure 9A:
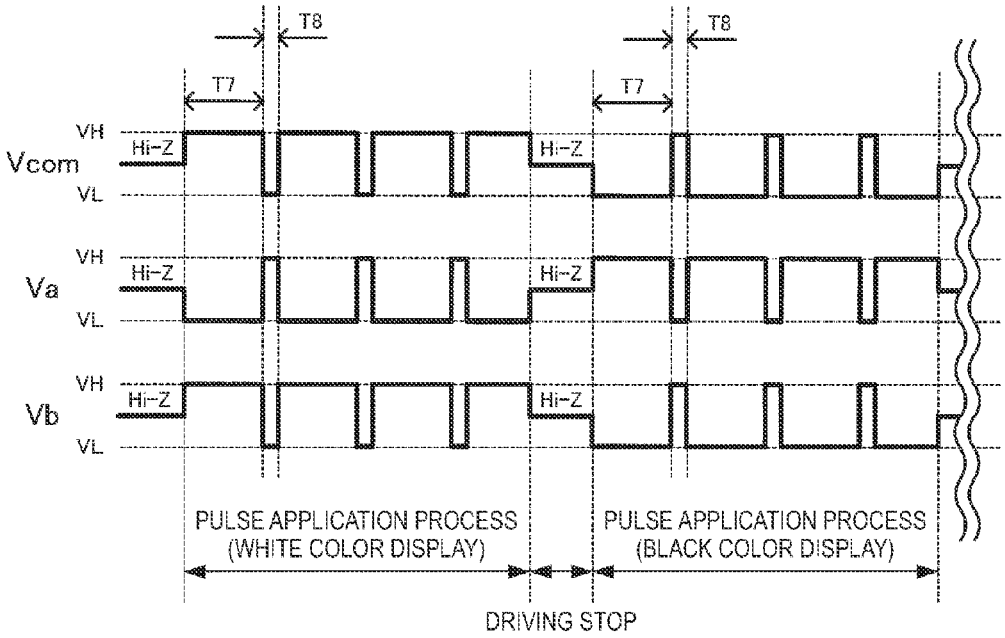
FIGS. 9A and 9B are diagrams illustrating reverse electric potential driving.

FIG. 9A is a diagram illustrating an example of the reverse electric potential driving pulse included in the driving pulse signal Vcom supplied to the common electrode. In Vcom, subsequent to a pulse of applying the first electric potential to the common electrode with a certain pulse width T7, a pulse (reverse electric potential driving pulse) of applying the second electric potential to the common electrode with a short pulse width T8 is continued, which is repeated. Here, at the final stage of the pulse application process of white color display or black color display, the first electric potential is exceptionally applied to the common electrode for termination. Using the reverse electric potential driving pulse having the short pulse width, it is possible to reduce the driving time at the partial rewriting time. Here, in the case of the white color display, the first electric potential is VH, and in the case of the black color display, the first electric potential is VL. Further, for example, T8 may be a short time of about 1% to 15% of T7.

In this example, Va supplied to the pixel electrode of the pixel 40A is a reverse signal of Vcom, and Vb supplied to the pixel electrode of the pixel 40B is the same signal as Vcom. The pixel 40A and the pixel 40B are two pixels shown in FIG. 3B, for example. The pixel 40A is rewritten from black to white in the pulse application process (white color display), and is rewritten from white to black in the pulse application process (black color display). On the other hand, in the pixel 40B, since the electric field is not generated between the common electrode and the pixel electrode, rewriting is not performed, and the black color display is continued.

Figure 9B:
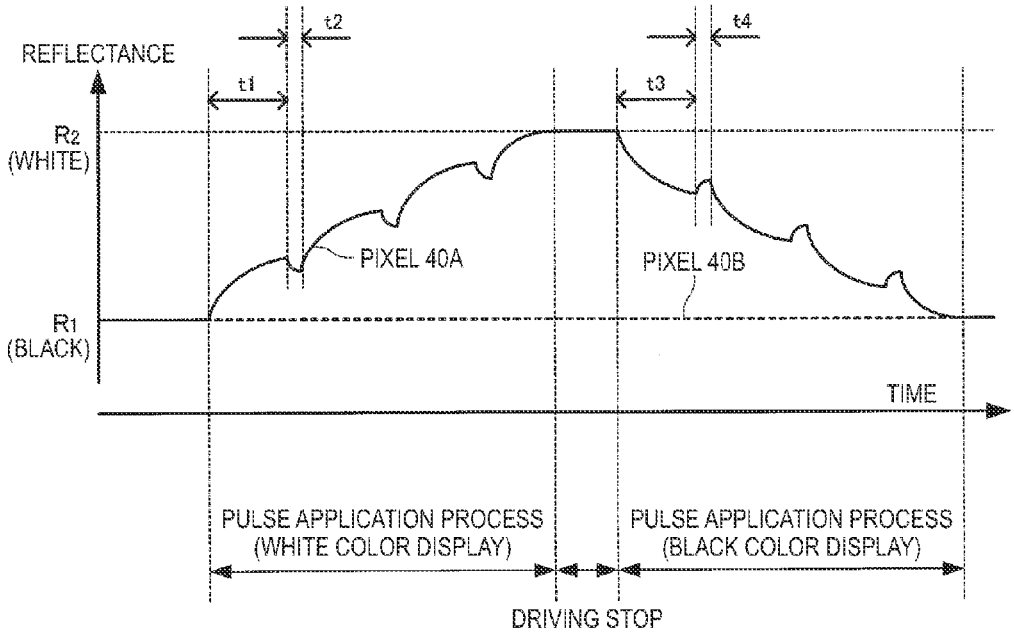

FIG. 9B is a diagram illustrating color changes of the pixel 40A and the pixel 40B according to the example of FIG. 9A. Firstly, the pixel 40A will be described. It is assumed that the pixel 40A displays black before a section t1. In the section t1 (corresponding to T7 in FIG. 9A), since the electric potential of the pixel electrode is VL, and the electric potential of the common electrode is VH, the white color display is approximately performed. However, in a subsequent section t2 (corresponding to T8 in FIG. 9A), since the electric potential of the pixel electrode is VH, and the electric potential of the common electrode is VL, the black color display is approximately performed. However, since T7>T8, the pixel 40A displays white at the final stage of the pulse application process (white color display). Further, the pixel 40A displays black at the final stage of the pulse application process (black color display) in which the polarity of Vcom is reversed. A section t3 corresponds to the section t1, and a section t4 corresponds to the section t2.

On the other hand, the pixel 40B continuously maintains the black color display before the section t1 without causing the electric potential difference since the same signal as the Vcom is constantly supplied to the pixel electrode. With such partial driving, it is possible to drive only pixels which should be changed, and to increase the response speed in the image rewriting. In particular, it is possible to reduce the driving time at the partial rewriting time by using the reverse electric potential driving pulse having the short pulse width.

2.1.2. Modification Using Reverse Electric Potential Driving Pulse

Figure 10:
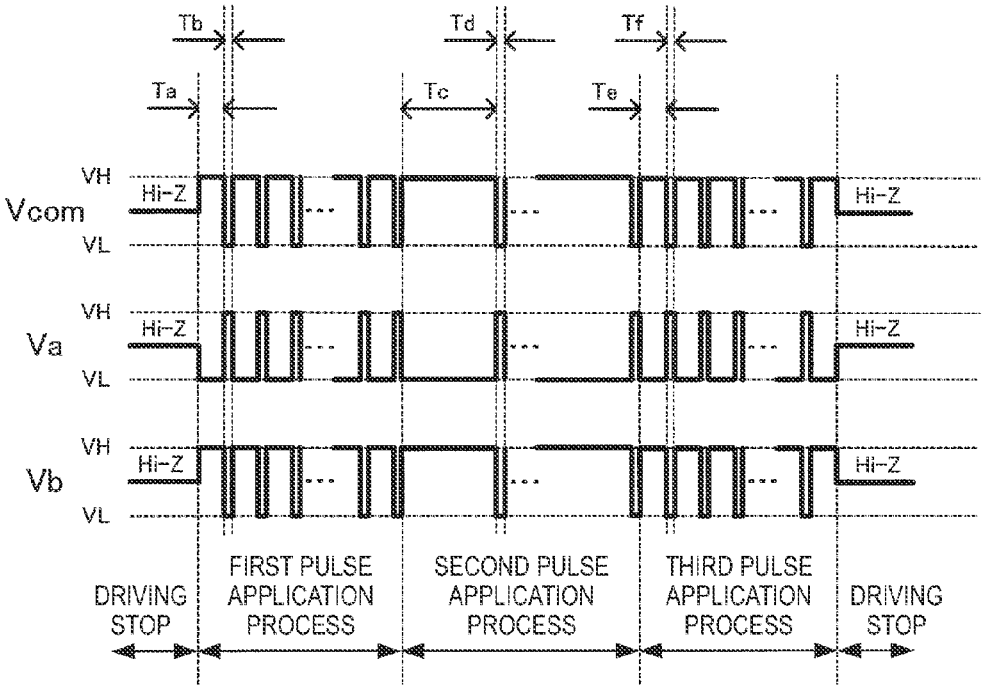
FIG. 10 is a diagram illustrating a driving method according to a modification.

FIG. 10 illustrates a modification using the reverse electric potential driving pulse. The same reference numerals are given to the same elements as in FIGS. 6A and 6B, and FIGS. 9A and 9B, and descriptions thereof will be omitted.

FIG. 10 is a waveform diagram illustrating a case where the pixel 40A is changed from black to white and the pixel 40B is maintained as black, using the driving method of the electrophoretic display device according to the present modification. In FIG. 10, through the image rewriting process, Va is a reverse signal of Vcom and Vb is the same signal of Vcom. Further, an electric potential different from the electric potential of the reverse electric potential driving pulse is the first electric potential. In this example, VH is the first electric potential. Accordingly, between Ta (first width), Tc (second width) and Te (third width) in FIG. 10, it is necessary that the same size relationship as in the first embodiment be established. The widths Tb, Td and Tf of the reverse electric potential pulses are determined in consideration of the time required for the partial driving, the demand that flickering is not generated in each of the first to third pulse application processes, or the like.

In the first pulse application process, Ta (first width) of the first pulse signal should be short so that flickering is not noticeable. Here, if Ta is excessively short, since a long time is taken for the first pulse application process, for example, Ta is set to 20 ms.

In the second pulse application process, Tc (second width) of the second pulse signal is a value larger than Ta (first width). For example, Tc is set to 200 ms so that the electrophoretic particles are moved until a sufficient reflectance is obtained.

In the third pulse application process, Te (third width) of the third pulse signal is a value smaller than Tc (second width). Thus, Te may have a pulse width which is equal to or smaller than that of Ta. For example, Te is set to 20 ms.

In the first pulse application process, a white reflectance is changed to about 80% of a desired reflectance without causing flickering. Further, in the second pulse application process, the reflectance is changed to reach an approximately desired white color by the second pulse signal having the long pulse width, to thereby obtain high contrast. Further, in the third pulse application process, the fine lines, patterns and shapes are clearly displayed by the third pulse signal having the short pulse width.

Contrary to this example, in a case where the white pixels are rewritten to the black pixels by the partial driving using the reverse electric potential driving pulse, the first electric potential becomes VL.

2.2. Application Example

An application example of the invention will be described with reference to FIGS. 11A and 11B. The electrophoretic display device 100 may be applied to a variety of electronic apparatuses.

Figure 11A:
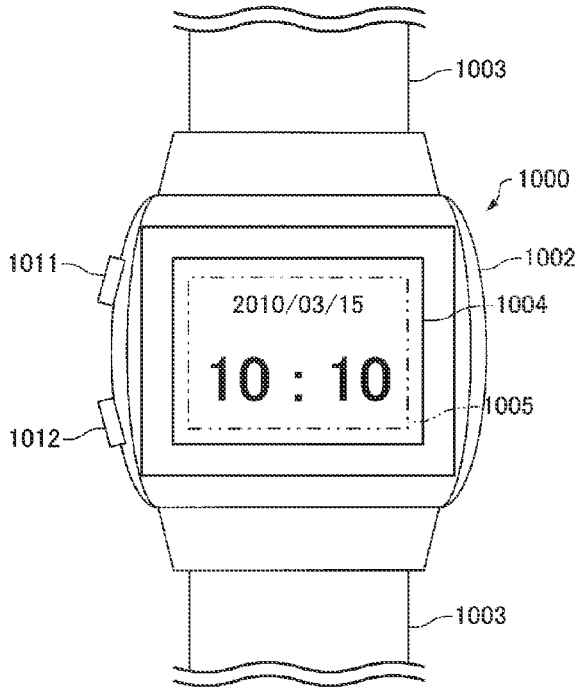
FIGS. 11A and 11B are diagrams illustrating an electronic apparatus according to an application example.

For example, FIG. 11A is a front view of a wrist watch 1000 which is a kind of electronic apparatus. The wrist watch 1000 includes a watch case 1002 and a pair of bands 1003 connected to the watch case 1002. At a front portion of the watch case 1002, a display portion 1004 which includes the electrophoretic display device 100 is disposed, and the display section 1004 performs a display 1005 which includes a time display. At a side portion of the watch case 1002, two operation buttons 1011 and 1012 are disposed. A variety of display types such as time, calendar, alarm or the like may be selected as the display 1005 by the operation buttons 1011 and 1012.

Figure 11B:
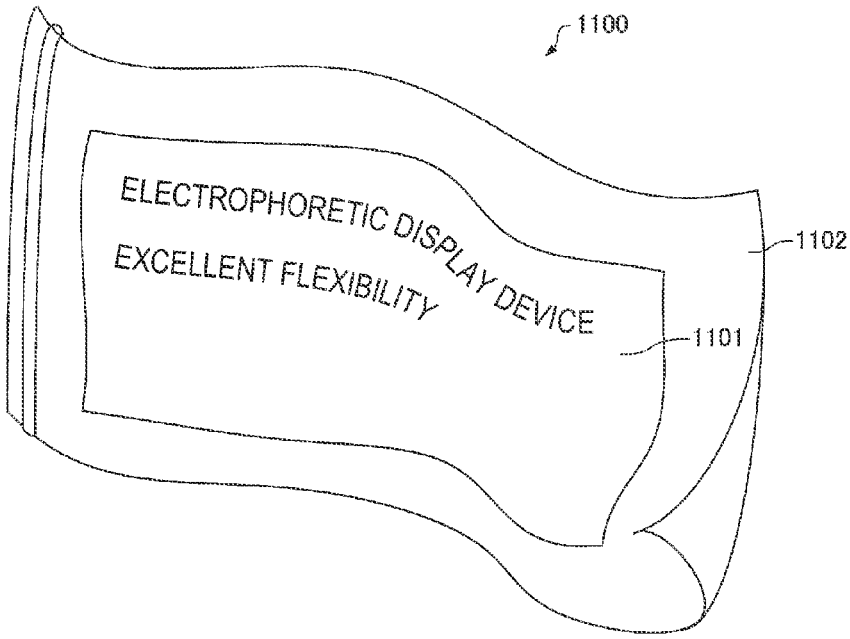

Further, FIG. 11B is a perspective view of an electronic paper 1100 which is a kind of electronic apparatus, for example. The electronic paper 1100 has flexibility, and includes a display area 1101 which includes the electrophoretic display device 100 and a main body 1102.

The electronic apparatus which includes the electrophoretic display device 100 can display a high quality image with high contrast without flickering.

3. Others

In the above-described embodiments, the electrophoretic display device is not limited to an electrophoretic display device of a two-particle system of black and white which uses black and white particles, but may be an electrophoretic display device of a single particle system of blue, white or the like, or may be an electrophoretic display device having a color combination other than the black and white combination.

Further, the invention is not limited to the electrophoretic display device, and the driving method may be applied to a display device with a memorizing ability. For example, the driving method may be applied to an ECD (electrochromic display), a ferroelectric liquid crystal display, a cholesteric liquid crystal display or the like.

The invention is not limited to the exemplary embodiments, and includes substantially the same configuration (for example, configuration having the same functions, methods and results or configuration having the same objects and effects) as the configuration described in the embodiments. Further, the invention includes a configuration in which sections which are not essential in the configuration described in the embodiments are replaced. Further, the invention includes a configuration having the same effects as the configuration described in the embodiments or a configuration capable of achieving the same objects. Further, the invention includes a configuration in which any known technology is added to the configuration described in the embodiments.

What is claimed is:

1. A driving method of an electrophoretic display device comprising:

the electrophoretic display device comprising:

a display section that comprises an electrophoretic element including electrophoretic particles; a plurality of pixel electrodes disposed on a first side of the electrophoretic element; a common electrode disposed on a second side of the electrophoretic element;

wherein the electrophoretic particles include a first electrophoretic particle that displays a first color and a second electrophoretic particle that displays a second color;

the method comprising:

drawing an image on the display section by applying a voltage based on a driving pulse signal that repeats a first electric potential and a second electric potential to the common electrode, and by applying any one of the first electric potential, the second electric potential and the voltage based on the driving pulse signal to each of the plurality of pixel electrodes, wherein the drawing comprises:

applying a first pulse signal of the driving pulse signal with the pulse width of the first electric potential being a first width;

applying a second pulse signal of the driving pulse signal with the pulse width of the first electric potential being a second width longer than the first width, after applying the first pulse signal; and applying a third pulse signal of the driving pulse signal with the pulse width of the first electric potential being a third width shorter than the second width, successively to applying the second pulse signal;

wherein, applying the third pulse signal, comprises (i) applying the third pulse signal to display the first color to terminate driving of the common electrode in a case in which the diameter of the second electrophoretic particle is larger than the diameter of the first electrophoretic particle, and (ii) applying the third pulse signal to display the second color to terminate driving of the common electrode in a case in which the diameter of the second electrophoretic particle is smaller than the diameter of the first electrophoretic particle.

2. The method according to claim 1, wherein the third width is equal to the first width.

3. The method according to claim 1, wherein the third width is shorter than the first width.

4. An electrophoretic display device comprising:

a display section that comprises an electrophoretic element including electrophoretic particles; a plurality of pixel electrodes disposed on a first side of the electrophoretic element; and a common electrode disposed on a second side of the electrophoretic element; and a control section which controls the display section, wherein the electrophoretic particles include a first electrophoretic that displays a first color and a second electrophoretic particle that displays a second color;

wherein the control section performs an operation for drawing an image on the display section by applying a voltage based on a driving pulse signal that repeats a first electric potential and a second electric potential to the common electrode, and by applying any one of the first electric potential, the second electric potential and the voltage based on the driving pulse signal to each of the plurality of pixel electrodes, and wherein the drawing operation comprises:

applying a first pulse signal of the driving pulse signal with the pulse width of the first electric potential being a first width;

applying a second pulse signal of the driving pulse signal with the pulse width of the first electric potential being a second width longer than the first width, after applying the first pulse signal; and applying a third pulse signal of the driving pulse signal with the pulse width of the first electric potential being a third width shorter than the second width, successively to applying the second pulse signal;

wherein applying the third pulse signal, comprises (i) applying the third pulse signal to display the first color to terminate driving of the common electrode in a case in which the diameter of the second electrophoretic particle is larger than the diameter of the first electrophoretic particle, and (ii) applying the third pulse signal to display the second color to terminate driving of the common electrode in a case in which the diameter of the second electrophoretic particle is smaller than the diameter of the first electrophoretic particle.

5. The electrophoretic display device according to claim 4, wherein the control section sets the third width to be equal to the first width.

6. An electronic apparatus comprising the electrophoretic display device according to claim 5.

7. An electronic apparatus comprising the electrophoretic display device according to claim 4.

8. The electrophoretic display device according to claim 4, wherein the control section sets the third width to be shorter than the first width.

9. An electronic apparatus comprising the electrophoretic display device according to claim 8.

* * * * *